US012297524B2

(12) United States Patent
Shuto et al.

(10) Patent No.: US 12,297,524 B2
(45) Date of Patent: May 13, 2025

(54) HOT-ROLLED STEEL SHEET

(71) Applicant: NIPPON STEEL CORPORATION, Tokyo (JP)

(72) Inventors: Hiroshi Shuto, Tokyo (JP); Kazumasa Tsutsui, Tokyo (JP); Koutarou Hayashi, Tokyo (JP); Akifumi Sakakibara, Tokyo (JP); Jun Ando, Tokyo (JP); Shota Endo, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 407 days.

(21) Appl. No.: 17/760,933

(22) PCT Filed: Sep. 4, 2020

(86) PCT No.: PCT/JP2020/033593
§ 371 (c)(1),
(2) Date: Mar. 16, 2022

(87) PCT Pub. No.: WO2021/065346
PCT Pub. Date: Apr. 8, 2021

(65) Prior Publication Data

US 2022/0389554 A1 Dec. 8, 2022

(30) Foreign Application Priority Data

Oct. 1, 2019 (JP) ..... 2019-181314

(51) Int. Cl.
*C22C 38/58* (2006.01)
*C22C 38/00* (2006.01)
(Continued)

(52) U.S. Cl.
CPC ..... *C22C 38/58* (2013.01); *C22C 38/001* (2013.01); *C22C 38/002* (2013.01);
(Continued)

(58) Field of Classification Search
CPC ... C21D 1/02; C21D 1/18; C21D 1/84; C21D 2211/005; C21D 6/008; C21D 8/0205;
(Continued)

(56) References Cited

U.S. PATENT DOCUMENTS 6,544,354 B1 4/2003 Kawano et al.
11,236,412 B2 * 2/2022 Sano ..... C23C 2/40
(Continued)

FOREIGN PATENT DOCUMENTS

CN 103459647 A 12/2013
CN 107250411 A 10/2017
(Continued)

OTHER PUBLICATIONS

Naik et al., "Texture-Based Metallurgical Phase Identification in Structural Steels: A Supervised Machine Learning Approach", Metals, 2019, vol. 9, 546, total 13 pages.
(Continued)

*Primary Examiner* — Jenny R Wu
(74) *Attorney, Agent, or Firm* — Birch, Stewart, Kolasch & Birch, LLP

(57) ABSTRACT

This hot-rolled steel sheet has a predetermined chemical composition, in which a microstructure contains, by area %, less than 3.0% of residual austenite, 15.0% or more and less than 60.0% of ferrite, and less than 5.0% of pearlite, has a ratio $L_{60}/L_7$ of a length $L_{60}$ of a grain boundary having a crystal misorientation of 60° to a length $L_7$ of a grain boundary having a crystal misorientation of 7° about a <110> direction of less than 0.60, has a standard deviation of a Mn concentration of 0.60 mass % or less, and has a tensile strength of 980 MPa or more.

5 Claims, 1 Drawing Sheet

(51) Int. Cl.

| | |
|---|---|
| ***C22C 38/02*** | (2006.01) |
| ***C22C 38/06*** | (2006.01) |
| ***C22C 38/12*** | (2006.01) |
| ***C22C 38/16*** | (2006.01) |
| ***C22C 38/50*** | (2006.01) |

(52) U.S. Cl.
CPC ..... *C22C 38/005* (2013.01); *C22C 38/008* (2013.01); *C22C 38/02* (2013.01); *C22C 38/06* (2013.01); *C22C 38/12* (2013.01); *C22C 38/16* (2013.01); *C22C 38/50* (2013.01)

(58) Field of Classification Search
CPC ..... C21D 8/0226; C21D 8/0263; C21D 9/46; C22C 38/001; C22C 38/002; C22C 38/005; C22C 38/008; C22C 38/02; C22C 38/04; C22C 38/06; C22C 38/08; C22C 38/12; C22C 38/14; C22C 38/16; C22C 38/24; C22C 38/26; C22C 38/28; C22C 38/34; C22C 38/38; C22C 38/50; C22C 38/58
See application file for complete search history.

(56) References Cited

U.S. PATENT DOCUMENTS

| | | | |
|---|---|---|---|
| 2014/0014236 | A1 | 1/2014 | Nozaki et al. |
| 2016/0273066 | A1 | 9/2016 | Sakakibara et al. |
| 2017/0349967 | A1 | 12/2017 | Yokoi et al. |
| 2018/0044749 | A1 | 2/2018 | Shuto et al. |
| 2021/0140005 | A1 | 5/2021 | Yoshida et al. |

FOREIGN PATENT DOCUMENTS

| | | | | |
|---|---|---|---|---|
| EP | 1 028 167 | A2 | 8/2000 | |
| EP | 3 650 569 | A1 | 5/2020 | |
| JP | 59-222528 | A | 12/1984 | |
| JP | 10-168544 | A | 6/1998 | |
| JP | 11-61326 | A | 3/1999 | |
| JP | 3355970 | B2 | 12/2002 | |
| JP | 2005-177903 | A | 7/2005 | |
| JP | 2005-179703 | A | 7/2005 | |
| JP | 2005-298924 | A | 10/2005 | |
| JP | 2007-70648 | A | 3/2007 | |
| JP | 2007-70661 | A | 3/2007 | |
| JP | 4109619 | B2 | 7/2008 | |
| JP | 2009-263685 | A | 11/2009 | |
| JP | 4460343 | B2 | 5/2010 | |
| JP | 2012-251200 | A | 12/2012 | |
| JP | 2015-124410 | A | 7/2015 | |
| JP | 2015-196891 | A | 11/2015 | |
| WO | 2014/185405 | A1 | 11/2014 | |
| WO | WO-2018026014 | A1 * | 2/2018 | ..... C21D 9/46 |
| WO | WO 2019/009410 | A1 | 1/2019 | |

OTHER PUBLICATIONS

Webel et al., "A new analysis approach based on Haralick texture features for the characterization of microstructure on the example of low-alloy steels", Materials Characterization, 2018, vol. 144, pp. 584-596.

Zuiderveld, "Contrast Limited Adaptive Histogram Equalization, Chapter Vill.5", Graphics Gems Iv. P.S. Heckbert (Eds.), Cambridge, MA, Academic Press, 1994, pp. 474-485.

* cited by examiner

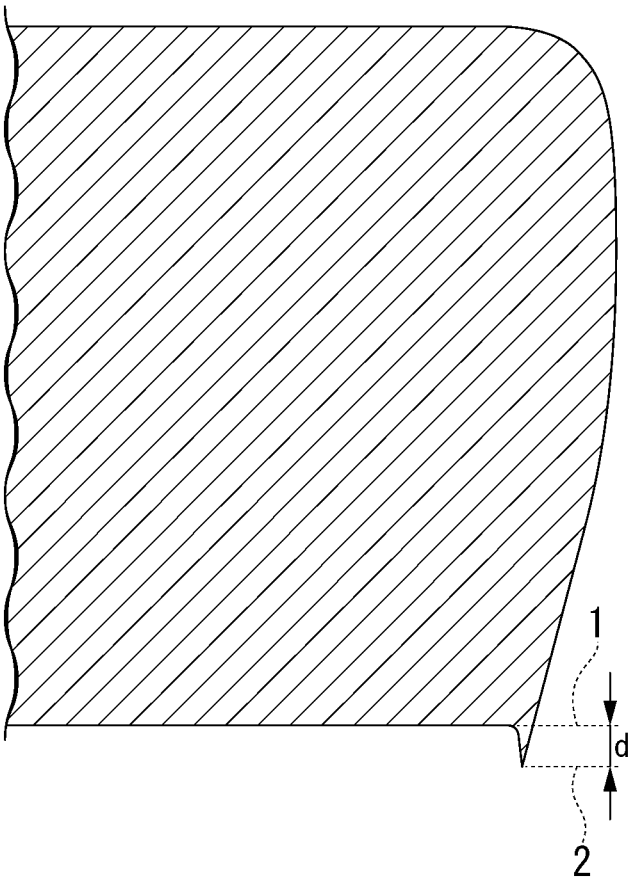
1
d
2

HOT-ROLLED STEEL SHEET

TECHNICAL FIELD

The present invention relates to a hot-rolled steel sheet. Specifically, the present invention relates to a hot-rolled steel sheet that is formed into various shapes by press working or the like to be used, and particularly relates to a hot-rolled steel sheet that has high strength and has excellent ductility and shearing workability. Priority is claimed on Japanese Patent Application No. 2019-181314, filed on Oct. 1, 2019, the content of which is incorporated herein by reference.

BACKGROUND ART

In recent years, from the viewpoint of protecting the global environment, efforts have been made to reduce the amount of carbon dioxide gas emitted in many fields. Vehicle manufacturers are also actively developing techniques for reducing the weight of vehicle bodies for the purpose of reducing fuel consumption. However, it is not easy to reduce the weight of vehicle bodies since the emphasis is placed on improvement in collision resistance to secure the safety of the occupants.

In order to achieve both vehicle body weight reduction and collision resistance, an investigation has been conducted to make a member thin by using a high strength steel sheet. Therefore, a steel sheet having both high strength and excellent formability is strongly desired. Several techniques have been proposed from the related art to meet these demands. Since there are various working methods for vehicle members, the required formability differs depending on members to which the working methods are applied, but among these, ductility is placed as an important index for formability. In addition, vehicle members are formed by press forming, and the press-formed blank sheet is often manufactured by highly productive shearing working. In particular, for a steel sheet having a high strength of 980 MPa or more, the load required for a post-treatment such as coining after shearing working becomes large, and thus it is desired to control the burr height after shearing working with particularly high accuracy so that there is no necessary to perform the post-treatment.

In the technique for improving ductility, for example, Patent Document 1 discloses a high strength steel sheet for a vehicle having excellent collision resistant safety and formability, in which residual austenite having an average grain size of 5 μm or less is dispersed in ferrite having an average grain size of 10 μm or less. In the steel sheet containing residual austenite in the microstructure, while the austenite is transformed into martensite during working and large elongation is exhibited due to transformation-induced plasticity, the formation of full hard martensite impairs hole expansibility. Patent Document 1 discloses that not only ductility but also hole expansibility are improved by refining the ferrite and the residual austenite.

Patent Document 2 discloses a high strength steel sheet having excellent ductility and stretch flangeability and having a tensile strength of 980 MPa or more, in which a second phase including residual austenite and/or martensite is finely dispersed in crystal grains.

In the technique for improving shearing workability, for example, Patent Document 3 discloses a technique for controlling burr height after punching by controlling a ratio ds/db of the ferrite grain size $D_s$ of the surface layer to ferrite grain $D_b$ of an inside to 0.95 or less.

Patent Document 4 discloses a technique for improving separations or burrs on an end surface of a plate by reducing a P content.

CITATION LIST

Patent Document

Patent Document 1: Japanese Unexamined Patent Application, First Publication No. H11-61326

Patent Document 2: Japanese Unexamined Patent Application, First Publication No. 2005-177903

Patent Document 3: Japanese Unexamined Patent Application, First Publication No. H10-168544

Patent Document 4: Japanese Unexamined Patent Application, First Publication No. 2005-298924

SUMMARY OF INVENTION

Technical Problem

The techniques disclosed in Patent Documents 1 to 4 are all techniques of improving either ductility or an end surface property after shearing working. However, Patent Documents 1 to 3 do not refer to a technique for achieving both of the properties. Patent Document 4 refers to both shearing workability and press formability. However, since the strength of a steel sheet disclosed in Patent Document 4 is less than 850 MPa, it may be difficult to apply the technique disclosed in Patent Document 4 to a member having a high strength of 980 MPa or more.

The present invention has been made in view of the above problems of the related art, and an object of the present invention is to provide a hot-rolled steel sheet having high strength and excellent ductility and shearing workability.

Solution to Problem

In view of the above-mentioned problems, as a result of intensive investigations on the chemical composition of a hot-rolled steel sheet and the relationship between the microstructure and the mechanical properties, the present inventors have obtained the following findings (a) to (h) and thus completed the present invention. In addition, the expression of having excellent shearing workability refers to that a burr height after shearing working is small. In addition, the expression of having excellent strength or having high strength refers to that tensile strength is 980 MPa or more.

(a) In order to obtain the excellent tensile (maximum) strength, it is preferable to use a full hard structure. That is, it is preferable that the structure contains the martensite or the bainite.

(b) However, since the full hard structure is a structure having poor ductility, excellent ductility cannot be secured simply with the microstructure mainly having the full hard structures.

(c) In order to allow a hot-rolled steel sheet having high strength to also have excellent ductility, it is effective to contain an appropriate amount of ferrite having high ductility.

(d) Since the ferrite is generally soft, it is necessary to use Ti, Nb, V, and the like as precipitation hardening elements in order to obtain desired strength. Therefore, it is necessary to perform intermediate air cooling in the hot rolling process to obtain an appropriate amount of precipitation hardened ferrite.

(e) A full hard structure is generally formed in a phase transformation at 600° C. or lower, but in this temperature range, a large number of a grain boundary having a crystal misorientation of 60° and a grain boundary having a crystal misorientation of 7° about the <110> direction in the temperature range are formed.

(f) When forming the grain boundary having a crystal misorientation of 7° about the <110> direction, dislocations are likely to accumulate in a full hard structure. In a hard phase, in this microstructure in which the density of grain boundaries is high and grain boundaries are uniformly dispersed (that is, a total length of the grain boundaries as described above is large), dislocations accumulate in the full hard structure during shearing working, cracks are easily initiated from inside the full hard structure. As a result, cracks are likely to be initiated even when shearing working is performed under a condition where the clearance is large, and the generation of excessive burrs is suppressed.

(g) In order to uniformly disperse the grain boundary having a crystal misorientation of 7° about the <110> direction in the hard phase, a standard deviation of a Mn concentration is required to be equal to or less than a certain value. In order to set the standard deviation of the Mn concentration to be equal to or less than a certain value, when a slab is heated, it is necessary to retain the slab in a temperature range of 700° C. to 850° C. for 900 seconds or longer, and then further heat the slab, retain in a temperature range of 1100° C. or higher for 6000 seconds or longer, and perform hot rolling so that a total sheet thickness is reduced by 90% or more in the temperature range of 850° C. to 1100° C. When the retention time is short or the sheet thickness is reduced a little, the microscopic segregation of Mn is increased. Therefore, the standard deviation of the Mn concentration cannot be set to be equal to or less than the certain value, and the grain boundary having a crystal misorientation of 7° is not uniformly dispersed.

(h) In order to increase the length of grain boundary having a crystal misorientation of 7° about the <110> direction, it is necessary to perform rapid cooling to a room temperature. When cooling is stopped at a temperature of 250° C. or higher, the length of the grain boundary decreases.

The gist of the present invention made based on the above findings is as follows.

(1) A hot-rolled steel sheet according to an aspect of the present invention includes, as a chemical composition, by mass %, C: 0.050% to 0.250%;
Si: 0.05% to 3.00%;
Mn: 1.00% to 4.00%;
One or two or more of Ti, Nb, or V: 0.060 to 0.500% in total;
sol. Al: 0.001% to 2.000%;
P: 0.100% or less;
S: 0.0300% or less;
N: 0.1000% or less;
O: 0.0100% or less;
Cu: 0% to 2.00%;
Cr: 0% to 2.00%;
Mo: 0% to 1.00%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or two or more of Zr, Co, Zn, or W: 0% to 1.00% in total;
Sn: 0% to 0.050%; and
a remainder comprising Fe and impurities,
in which a microstructure at a depth of ¼ of a sheet thickness from a surface and at a center position in a sheet width direction in a cross section parallel to a rolling direction contains, by area %, less than 3.0% of residual austenite, 15.0% or more and less than 60.0% of ferrite, and less than 5.0% of pearlite, has a ratio $L_{60}/L_7$ of a length $L_{60}$ of a grain boundary having a crystal misorientation of 60° to a length $L_7$ of a grain boundary having a crystal misorientation of 7° about a <110> direction of less than 0.60, has a standard deviation of a Mn concentration of 0.60 mass % or less, and has a tensile strength of 980 MPa or more.

(2) In the hot-rolled steel sheet according to (1), an average grain size of a surface layer may be less than 3.0 μm.

(3) The hot-rolled steel sheet according to (1) or (2) may include, as the chemical composition, by mass %, one or two or more selected from the group consisting of Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

Advantageous Effects of Invention

According to the above aspect of the present invention, it is possible to obtain a hot-rolled steel sheet having excellent strength, ductility, and shearing workability. Further, according to a preferred embodiment according to the present invention, it is possible to obtain a hot-rolled steel sheet having the above-mentioned properties and further suppressing the initiation of cracking inside a bend, that is, having excellent resistance to cracking inside a bend.

The hot-rolled steel sheet according to the above aspect of the present invention is suitable as an industrial material used for vehicle members, mechanical structural members, and building members.

BRIEF DESCRIPTION OF DRAWING

FIG. 1 is a diagram illustrating burr height after shearing working.

EMBODIMENTS OF THE INVENTION

The chemical composition and microstructure of a hot-rolled steel sheet (hereinafter, sometimes simply referred to as a steel sheet) according to the present embodiment will be described in detail below. However, the present invention is not limited to the configuration disclosed in the present embodiment, and various modifications can be made without departing from the scope of the present invention. The numerical limit range described with "to" in between includes the lower limit and the upper limit. Regarding the numerical value indicated by "less than" or "more than", the value does not fall within the numerical range. In the following description, % regarding the chemical composition of a steel sheet is mass % unless otherwise specified.

1. Chemical Composition

The hot-rolled steel sheet according to the present embodiment includes, by mass %, C: 0.050% to 0.250%, Si: 0.05% to 3.00%, Mn: 1.00% to 4.00%, one or two or more of Ti, Nb, or V: 0.060% to 0.500% in total, sol. Al: 0.001% to 2.000%, P: 0.100% or less, S: 0.0300% or less, N: 0.1000% or less, O: 0.0100% or less, and a remainder comprising Fe and impurities. Each element will be described in detail below.

(1-1) C: 0.050% to 0.250%

C increases the fraction of the hard phase and increases the strength of the ferrite by combining with precipitation hardening elements such as Ti, Nb, and V. When the C content is less than 0.050%, it is difficult to obtain a desired strength. Therefore, the C content is set to 0.050% or more. The C content is preferably 0.060% or more, more preferably 0.070% or more, and even more preferably 0.080% or more. On the other hand, when the C content is more than 0.250%, the ferrite fraction decreases, so that the ductility of the hot-rolled steel sheet decreases. Therefore, the C content is set to 0.250% or less. The C content is preferably 0.200% or less and more preferably 0.150% or less.

(1-2) Si: 0.05% to 3.00%

Si has an action of promoting the formation of ferrite to improve the ductility of the hot-rolled steel sheet and an action of solid solution strengthening the ferrite to increase the strength of the hot-rolled steel sheet. In addition, Si has an action of making the steel sound by deoxidation (suppressing the occurrence of defects such as blow holes in the steel). When the Si content is less than 0.05%, an effect by the action cannot be obtained. Therefore, the Si content is set to 0.05% or more. The Si content is preferably 0.50% or more and more preferably 0.80% or more. However, when the Si content is more than 3.00%, the surface properties, the chemical convertibility, the ductility, and the weldability of the hot-rolled steel sheet are significantly deteriorated, and the $A_3$ transformation point is significantly increased. This makes it difficult to perform hot rolling in a stable manner. Therefore, the Si content is set to 3.00% or less. The Si content is preferably 2.70% or less and more preferably 2.50% or less.

(1-3) Mn: 1.00% to 4.00%

Mn has actions of suppressing ferritic transformation and high-strengthening the hot-rolled steel sheet. When the Mn content is less than 1.00%, the tensile strength of 980 MPa or more cannot be obtained. Therefore, the Mn content is set to 1.00% or more. The Mn content is preferably 1.50% or more and more preferably 1.80% or more. On the other hand, when the Mn content is more than 4.00%, an angular difference of the crystal grain in the hard phase becomes non-uniform due to the segregation of Mn, and it becomes difficult to obtain a desired shearing workability. Therefore, the Mn content is set to 4.00% or less. The Mn content is preferably 3.70% or less and more preferably 3.50% or less.

(1-4) One or Two or More of Ti, Nb, or V: 0.060 to 0.500% in Total

Ti, Nb, and V are elements that are finely precipitated in steel as carbides and nitrides and improve the strength of steel by precipitation hardening. In addition, these elements are elements that fix C by forming the carbides and suppress the formation of cementite, which is harmful to shearing workability. In order to obtain these effects, the total amount of Ti, Nb, and V is set to 0.060% or more. It is not necessary that all of Ti, Nb, and V are contained, and any one of these elements may be contained. In a case where only one kind is contained, the amount of the element may be 0.060% or more. When the amount of any one of the elements is 0.060% or more, the above effect can be obtained. The total amount of the Ti, Nb, and V is preferably 0.080% or more, more preferably 0.090% or more, and even more preferably 0.100% or more. On the other hand, when the total amount of Ti, Nb, and V is more than 0.500%, the workability is deteriorated. Therefore, the total amount of Ti, Nb, and V is set to 0.500% or less. The total amount is preferably 0.300% or less, more preferably 0.250% or less, and even more preferably 0.120% or less.

(1-5) sol. Al: 0.001% to 2.000%

Similar to Si, Al has an action of deoxidizing the steel to make the steel sheet soundness, and also has an action of promoting the formation of ferrite and increasing the ductility of the hot-rolled steel sheet. When the sol. Al content is less than 0.001%, the effect by the action cannot be obtained. Therefore, the sol. Al content is set to 0.001% or more. The sol. Al content is preferably 0.010% or more. On the other hand, when the sol. Al content is more than 2.000%, the above effects are saturated and this case is not economically preferable. Thus, the sol. Al content is set to 2.000% or less. The sol. Al content is preferably 1.500% or less or 1.300% or less. In addition, sol. Al means acid-soluble Al, and refers to solid solution Al present in steel in a solid solution state.

(1-6) P: 0.100% or Less

P is an element that is generally contained as an impurity and is also an element having an action of enhancing the strength of the hot-rolled steel sheet by solid solution strengthening. Therefore, P may be positively contained. However, P is an element that is easily segregated, and when the P content is more than 0.100%, the formability and toughness are significantly decreased due to the boundary segregation. Therefore, the P content is set to 0.100% or less. The P content is preferably 0.030% or less. The lower limit of the P content does not need to be particularly specified, but is preferably 0.001% from the viewpoint of refining cost.

(1-7) S: 0.0300% or Less

S is an element that is contained as an impurity and forms sulfide-based inclusions in the steel to decrease the formability of the hot-rolled steel sheet. When the S content is more than 0.0300%, the formability of the hot-rolled steel sheet is significantly decreased. Therefore, the S content is set to 0.0300% or less. The S content is preferably 0.0050% or less. The lower limit of the S content does not need to be particularly specified, but is preferably 0.00010% from the viewpoint of refining cost.

(1-8) N: 0.1000% or Less

N is an element contained in steel as an impurity and has an action of decreasing the formability of the hot-rolled steel sheet. When the N content is more than 0.1000%, the formability of the hot-rolled steel sheet is significantly decreased. Therefore, the N content is set to 0.1000% or less. The N content is preferably 0.0800% or less and more preferably 0.0700% or less. Although the lower limit of the N content does not need to be particularly specified, in a case where one or two or more of Ti, Nb, or V are contained to further refine the microstructure, the N content is preferably 0.0010% or more and more preferably 0.0020% or more to promote the precipitation of carbonitride.

(1-9) O: 0.0100% or Less

When a large amount of O is contained in the steel, O forms a coarse oxide that becomes the origin of fracture, and causes brittle fracture and hydrogen-induced cracks. Therefore, the O content is set to 0.0100% or less. The O content is preferably 0.0080% or less or 0.0050% or less. The O content may be 0.0005% or more or 0.0010% or more to disperse a large number of fine oxides when the molten steel is deoxidized.

The remainder of the chemical composition of the hot-rolled steel sheet according to the present embodiment may be Fe and impurities. In the present embodiment, the impurities mean those mixed from ore as a raw material, scrap, manufacturing environment, and the like, or those allowed within a range that does not adversely affect the hot-rolled steel sheet according to the present embodiment.

The hot-rolled steel sheet according to the present embodiment may contain Cu, Cr, Mo, Ni, B, Ca, Mg, REM, Bi, Zr, Co, Zn, W, and Sn as optional elements, instead of a part of Fe. In a case where the above optional elements are not contained, the lower limit of the content thereof is 0%. Hereinafter, the above optional elements will be described in detail.

(1-10) Cu: 0.01% to 2.00%, Cr: 0.01% to 2.00%, Mo: 0.01% to 1.00%, Ni: 0.02% to 2.00%, and B: 0.0001% to 0.0100%

All of Cu, Cr, Mo, Ni, and B have an action of enhancing the hardenability of the hot-rolled steel sheet. In addition, Cr and Ni have an action of stabilizing residual austenite, and Cu and Mo have an effect of being precipitated as carbides in the steel to increase the strength of the hot-rolled steel sheet. Further, in a case where Cu is contained, Ni has an action of effectively suppressing the grain boundary crack of the slab caused by Cu. Therefore, one or two or more of these elements may be contained.

As described above, Cu has an action of enhancing the hardenability of the hot-rolled steel sheet and an effect of precipitating as carbide in the steel at a low temperature to enhance the strength of the hot-rolled steel sheet. In order to more reliably obtain the effect by the action, the Cu content is preferably 0.01% or more and more preferably 0.05% or more. However, when the Cu content is more than 2.00%, grain boundary cracks may occur in the slab in some cases. Therefore, the Cu content is set to 2.00% or less. The Cu content is preferably 1.50% or less or 1.00% or less.

As described above, Cr has an action of enhancing the hardenability of the hot-rolled steel sheet and an action of stabilizing residual austenite. In order to more reliably obtain the effect by the action, the Cr content is preferably set to 0.010% or more and more preferably set to 0.05% or more. However, when the Cr content is more than 2.00%, the chemical convertibility of the hot-rolled steel sheet is significantly decreased. Accordingly, the Cr content is set to 2.00% or less.

As described above, Mo has an action of enhancing the hardenability of the hot-rolled steel sheet and an action of being precipitated as carbides in the steel to enhance the strength of the hot-rolled steel sheet. In order to more reliably obtain the effect by the action, the Mo content is preferably set to 0.010% or more and more preferably set to 0.02% or more. However, even when the Mo content is set to be more than 1.00%, the effect by the action is saturated, and this case is not economically preferable. Therefore, the Mo content is set to 1.00% or less. The Mo content is preferably 0.50% or less or 0.20% or less.

As described above, Ni has an action of enhancing the hardenability of the hot-rolled steel sheet. In addition, when Cu is contained, Ni has an action of effectively suppressing the grain boundary crack of the slab caused by Cu. In order to more reliably obtain the effect by the action, the Ni content is preferably 0.02% or more. Since Ni is an expensive element, it is not economically preferable to contain a large amount of Ni. Therefore, the Ni content is set to 2.00% or less.

As described above, B has an action of enhancing the hardenability of the hot-rolled steel sheet. In order to more reliably obtain the effect by the action, the B content is preferably set to 0.0001% or more and more preferably set to 0.0002% or more. However, when the B content is more than 0.0100%, the formability of the hot-rolled steel sheet is significantly decreased, and thus the B content is set to 0.0100% or less. The B content is preferably 0.0050% or less.

(1-11) Ca: 0.0005% to 0.0200%, Mg: 0.0005% to 0.0200%, REM: 0.0005% to 0.1000%, and Bi: 0.0005% to 0.020%

All of Ca, Mg, and REM have an action of enhancing the formability of the hot-rolled steel sheet by adjusting the shape of inclusions in the steel to a preferable shape. In addition, Bi has an action of enhancing the formability of the hot-rolled steel sheet by refining the solidification structure. Therefore, one or two or more of these elements may be contained. In order to more reliably obtain the effect by the action, it is preferable that the amount of any one or more of Ca, Mg, REM, or Bi is set to 0.0005% or more. However, when the Ca content or Mg content is more than 0.0200%, or when the REM content is more than 0.1000%, the inclusions are excessively formed in the steel, and thus the formability of the hot-rolled steel sheet may be decreased in some cases. In addition, even when the Bi content is more than 0.020%, the above effect by the action is saturated, and this case is not economically preferable. Therefore, the Ca content and Mg content are set to 0.0200% or less, the REM content is set to 0.1000% or less, and the Bi content is set to 0.020% or less. The Bi content is preferably 0.010% or less.

Here, REM refers to a total of 17 elements including Sc, Y, and lanthanoid, and the REM content refers to the total amount of these elements. In the case of lanthanoid, lanthanoid is industrially added in the form of misch metal.

(1-12) One or Two or More of Zr, Co, Zn, or W: 0% to 1.00% in Total and Sn: 0% to 0.050%

Regarding Zr, Co, Zn, and W, the present inventors have confirmed that even when the total content of these elements is 1.00% or less, the effect of the hot-rolled steel sheet according to the present embodiment is not impaired. Therefore, one or two or more of Zr, Co, Zn, or W may be contained in a total of 1.00% or less. Further, the present inventors have confirmed that the effect of the hot-rolled steel sheet to the present embodiment is not impaired even if a small amount of Sn is contained. However, when a large amount of Sn is contained, a defect may occur during hot rolling, and thus, the Sn content is set to 0.050% or less.

2. Microstructure of Hot-Rolled Steel Sheet

Next, the microstructure of the hot-rolled steel sheet according to the present embodiment will be described.

In the hot-rolled steel sheet according to the present embodiment, a microstructure at a depth of ¼ of a sheet thickness from a surface and at a center position in a sheet width direction in a cross section parallel to a rolling direction contains, by area %, less than 3.0% of residual austenite, 15.0% or more and less than 60.0% of ferrite, and less than 5.0% of pearlite, has a ratio $L_{60}/L_7$ of a length $L_{60}$ of a grain boundary having a crystal misorientation of 60° to a length $L_7$ of a grain boundary having a crystal misorientation of 7° about a <110> direction of less than 0.60, and has a standard deviation of a Mn concentration of 0.60 mass % or less. Therefore, in the hot-rolled steel sheet according to the present embodiment, it is possible to obtain high strength and excellent ductility and shearing workability. In the present embodiment, the reason for defining the microstructure at the depth of ¼ of the sheet thickness from the surface and the center position in the sheet width direction in the cross section parallel to the rolling direction is that the microstructure at this position is a typical microstructure of the steel sheet.

(2-1) Area Fraction of Residual Austenite: Less than 3.0%

The residual austenite is a microstructure that is present as a face-centered cubic lattice even at room temperature. The residual austenite has an action of increasing the ductility of the hot-rolled steel sheet due to transformation-induced plasticity (TRIP). On the other hand, the residual austenite transforms into high-carbon martensite during shearing working, which hinders stable crack initiation and causes coarse burrs. When the area fraction of the residual austenite is 3.0% or more, the action is manifested, shearing workability of the hot-rolled steel sheet is deteriorated. Therefore, the area fraction of the residual austenite is set to less than 3.0%. The area fraction of the residual austenite is preferably less than 1.0%. Since less residual austenite is preferable, the area fraction of the residual austenite may also be 0%.

As the measurement method of the area fraction of the residual austenite, methods by X-ray diffraction, electron back scatter diffraction image (EBSP, electron back scattering diffraction pattern) analysis, and magnetic measurement and the like may be used and the measured values may differ depending on the measurement method. In the present embodiment, the area fraction of the residual austenite is measured by X-ray diffraction.

In the measurement of the area fraction of the residual austenite by X-ray diffraction in the present embodiment, first, the integrated intensities of a total of 6 peaks of $\alpha(110)$, $\alpha(200)$, $\alpha(211)$, $\gamma(111)$, $\gamma(200)$, and $\gamma(220)$ are obtained in the cross section parallel to the rolling direction at a depth of ¼ of the sheet thickness of the hot-rolled steel sheet and the center position in the sheet width direction, using Co-Ku rays, and the area fraction of the residual austenite is obtained by calculation using the strength averaging method.

(2-2) Area Fraction of Ferrite: 15.0% or More and Less than 60.0%

Ferrite is a structure formed when fcc transforms into bcc at a relatively high temperature. The ferrite has a high work hardening rate, and thus has an action of enhancing the strength-ductility balance of the hot-rolled steel sheet. In order to obtain the action, the area fraction of the ferrite is set to 15.0% or more. The area fraction of the ferrite is preferably 16.0% or more. On the other hand, since the ferrite has low strength, it is not possible to obtain a desired tensile strength when the area fraction is excessive. Therefore, the ferrite area fraction is set to less than 60.0%. The area fraction of the ferrite is preferably 50.0% or less.

The hot-rolled steel sheet according to the present embodiment may contain a full hard structure including one or two or more of bainite or martensite with a total area fraction of more than 32.0% and 85.0% or less, as the remainder in microstructure other than the residual austenite, ferrite, and pearlite.

(2-3) Area Fraction of Pearlite: Less than 5.0%

Pearlite is a lamellar microstructure in which cementite is precipitated in layers between ferrite, and is a soft microstructure as compared with bainite and martensite. When the area fraction of the pearlite is 5.0% or more, carbon is consumed by the cementite contained in the pearlite, the strength of martensite or bainite, which is the remainder in microstructure, is lowered, and the tensile strength of 980 MPa or more cannot be obtained. Therefore, the area fraction of the pearlite is set to less than 5.0%. The area fraction of the pearlite is preferably 3.0% or less. In order to improve the stretch flangeability of the hot-rolled steel sheet, it is preferable to reduce the area fraction of the pearlite as possible, a lower limit thereof is set to 0%.

Measurement of the area fraction of the ferrite and the pearlite is conducted in the following manner. The cross section parallel to the rolling direction at the center position in the sheet width direction is mirror-finished and polished at a room temperature with colloidal silica without containing an alkaline solution for 8 minutes to remove the strain introduced into the surface layer of a sample. A region with a length of 50 μm and between a depth of ⅛ of the sheet thickness from the surface to a depth of ⅜ of the sheet thickness from the surface is measured by electron backscatter diffraction at a measurement interval of 0.1 μm, such that a microstructure at the depth of ¼ of the sheet thickness from the surface, in a random position of the sample cross section in a longitudinal direction can be analyzed, to obtain crystal orientation information. For the measurement, an EBSD analyzer configured of a thermal field emission scanning electron microscope (JSM-7001F manufactured by JEOL) and an EBSD detector (DVC5 type detector manufactured by TSL) is used. In this case, the EBSD analyzer is set such that the degree of vacuum inside is $9.6\times10^{-5}$ Pa or less, an acceleration voltage is 15 kv, an irradiation current level is 13, and an electron beam irradiation level is 62.

Further, a reflected electron image is captured in the same visual field. First, crystal grains in which ferrite and cementite are precipitated in layers are identified from a reflected electron image, and the area fraction of the crystal grains is calculated to obtain the area fraction of pearlite. Then, for crystal grains excluding the crystal grains determined as the pearlite, a region where a Grain Average Misorientation value is 1.0° or less is determined to be ferrite, using the obtained crystal orientation information in a "Grain Average Misorientation" installed in the software "OIM Analysis (registered trademark) attached to the EBSD analyzer. When determining the area fraction of the region determined as the ferrite, the area fraction of the ferrite is obtained.

The area fraction of the remainder in microstructure is obtained by subtracting the area fraction of the residual austenite, the area fraction of the ferrite, and the area fraction of the pearlite from 100%.

(2-4) Ratio $L_{60}/L_7$ of a Length $L_{60}$ of Grain Boundary Having Crystal Misorientation of 60° to a Length $L_7$ of Grain Boundary Having Crystal Misorientation of 7° about <110> Direction: Less than 0.60

In order to obtain a high strength of 980 MPa or more, the primary phase is required to have a full hard structure. The full hard structure is generally formed in a phase transformation at 600° C. or lower, but in this temperature range, a large number of a grain boundary having a crystal misorientation of 60° and a grain boundary having a crystal misorientation of 7° about the <110> direction in the temperature range are formed. When forming the grain boundary having a crystal misorientation of 7° about the <110> direction, dislocations are less likely to accumulate in a full hard structure. Therefore, in a hard phase, in this microstructure in which the density of grain boundary is high and grain boundaries are uniformly dispersed (that is, a total length of the grain boundaries as described above is large), strains are likely to concentrate inside the full hard structure due to the deformation of the hard phase, and thus cracks are easily initiated. As a result, cracks are likely to be initiated from both the punch side and the die side even when shearing working is performed under a condition where the clearance is large, and the generation of excessive burrs is suppressed.

On the other hand, in the grain boundary having a crystal misorientation of 60° about the <110> direction, dislocations are likely to accumulate in a hard phase. Therefore, in the hard phase, this microstructure in which the density of grain boundary is high, the hard phase is not deformed, and thus it is difficult that dislocation is introduced into the hard phase during shearing working. As a result, the crack initiation from the inside of the hard phase is suppressed, and thus the formation of burrs is delayed and the generation of excessive burrs is promoted. Therefore, when the length of a grain boundary having a crystal misorientation of 60° is set to $L_{60}$ and the length of the grain boundary having a crystal misorientation of 7° about a <110> direction is set to $L_7$, the occurrence of excessive burr formation after shearing working is dominated by $L_{60}/L_7$ under the conditions of large clearance. In a case where the $L_{60}/L_7$ is 0.60 or more, excessive burrs are likely to occur due to the action. Therefore, in order to improve the shearing workability of the hot-rolled steel sheet, it is necessary to set $L_{60}/L_7$ to less than 0.60.

The grain boundary having a crystal misorientation of X° about the <110> direction refers to a grain boundary having a crystallographic relationship in which the crystal orientations of the crystal grain A and the crystal grain B are the same by rotating one crystal grain B by X° along the <110> axis, when two adjacent crystal grain A and crystal grain B are specified at a certain grain boundary. However, considering the measurement accuracy of the crystal orientation, an orientation difference of 4° is allowed from the matching orientation relationship.

In the present embodiment, the length $L_7$ of a grain boundary and the length $L_{60}$ as above are measured by using the electron back scatter diffraction pattern-orientation image microscopy (EBSP-OIM) method. In the EBSP-OIM method, a crystal orientation of an irradiation point can be measured for a short time period in such manner that a highly inclined sample in a scanning electron microscope (SEM) is irradiated with electron beams, a Kikuchi pattern formed by back scattering is photographed by a high sensitive camera, and the photographed image is processed by a computer. The EBSP-OIM method is performed using a device in which a scanning electron microscope and an EBSP analyzer are combined and an OIM Analysis (registered trademark) manufactured by AMETEK Inc. In the EBSP-OIM method, since the fine structure of the sample surface and the crystal orientation can be analyzed, the length of the grain boundary having a specific crystal misorientation can be quantitatively determined. The analyzable area of the EBSP-OIM method is a region that can be observed by the SEM. The EBSP-OIM method makes it possible to analyze a region with a minimum resolution of 20 nm, which varies depending on the resolution of the SEM.

When measuring the length of specific grain boundary of the microstructure at the depth of ¼ of the sheet thickness from the surface of the steel sheet and at the center position in the sheet width direction in the cross section parallel to the rolling direction, an analysis is performed in at least 5 visual fields of a region of 40 μm×30 μm at a magnification of 1200 times and an average value of the lengths of the grain boundary having a crystal misorientation of 60° about the <110> direction is calculated to obtain $L_{60}$. Similarly, an average value of the lengths of the grain boundary having a crystal misorientation of 7° about the <110> direction is calculated to obtain $L_7$. As described above, the orientation difference of 4° is allowed.

The ferrite and the pearlite are soft phases and have a small effect on the dislocation accumulation effect inside the hard phase, and the residual austenite is not a structure formed by a phase transformation at 600° C. or lower and has no dislocation accumulation effect. Therefore, the ferrite, the pearlite, and the residual austenite are not included in an analysis target in the present measurement method. The pearlite is identified in the same manner as the measurement method of the area fraction of the pearlite and the ferrite is identified in the same manner as the measurement method of the area fraction of the ferrite, so that the pearlite and the ferrite can be excluded from the analysis target. In addition, the EBSP-OIM method, the residual austenite having a crystal structure of fcc can be excluded from the analysis target.

(2-5) Standard Deviation of Mn Concentration: 0.60 Mass % or Less

The standard deviation of Mn concentration at the depth of ¼ of the sheet thickness from the surface of the hot-rolled steel sheet according to the present embodiment and the center position in the sheet width direction is 0.60 mass % or less. Accordingly, the grain boundary having a crystal misorientation of 7° about the <110> direction can be uniformly dispersed. As a result, excellent shearing workability can be obtained. A lower limit of the standard deviation of the Mn concentration is preferably as small as the value from the viewpoint of suppressing excessive burrs, but a practical lower limit is 0.10 mass % due to the restrictions of the manufacturing process.

The cross section parallel to the rolling direction of the hot-rolled steel sheet is mirror polished, and the center position in the sheet width direction at the depth of ¼ of the sheet thickness from the surface of the hot-rolled steel sheet is measured using an electron probe microanalyzer (EPMA) to measure the standard deviation of the Mn concentration. The measurement condition is set such that an acceleration voltage is 15 kV and the magnification is 5000 times, and a distribution image in the range of 20 μm in the sample rolling direction and 20 μm in the sample sheet thickness direction is measured. More specifically, the measurement interval is set to 0.1 μm, and the Mn concentration at 40000 or more points is measured. Then, a standard deviation based on the Mn concentration obtained from all the measurement points is calculated to obtain the standard deviation of the Mn concentration.

(2-6) Average Grain Size of Surface Layer: Less than 3.0 μm

When the grain size of the surface layer is fine, it is possible to suppress cracking inside a bend of the hot-rolled steel sheet. As the strength of the steel sheet becomes higher, cracks are likely to initiate from an inside of a bend during bending (hereinafter referred to as cracking inside a bend). The mechanism of the cracking inside a bend is presumed as follows. During bending, compressive stress is generated inside the bend. At first, bending proceeds while uniformly deforming the entire inside of the bend, but when the bending amount increases, the deformation cannot be carried out only by uniform deformation, and the deformation proceeds due to the concentration of strain locally (generation of deformation band). As this deformation band further propagates, cracks along the shearing band are initiated from the inner surface of the bend and propagate. The reason why the cracking inside a bend is more likely to be initiated along with the high-strengthening is presumed that when uniform deformation is less likely to proceed due to the decrease in work hardening ability along with the strength increasing and a deformation bias is likely to occur, a deformation band is formed at an early stage of working (or in a mild working condition).

According to the research by the present inventors, it was found that the cracking inside a bend becomes remarkable in the steel sheet having a level of the tensile strength of 980 MPa or more. Furthermore, the present inventors have found that as the grain size of the surface layer of the hot-rolled steel sheet is finer, the local strain concentration is further suppressed and the cracking inside a bend becomes difficult to be initiated. In order to obtain the action, it is preferable that the average grain size of the surface layer of the hot-rolled steel sheet is less than 3.0 μm. It is more preferable that the average grain size is 2.5 μm or less.

In the present embodiment, the surface layer is a region from the surface of the hot-rolled steel sheet to a position at a depth of 50 μm from the surface.

The grain size of the surface layer is measured by using the EBSP-OIM method. In the cross section parallel to the rolling direction, a region from the surface of the hot-rolled steel sheet to a position at a depth of 50 μm from the surface and the center position in the sheet width direction is analyzed with 1200 fold magnification, in a region of 40 μm×30 μm, for at least 5 visual fields, a place where the angular difference between adjacent measurement points is 5° or more is defined as a grain boundary, and an area average grain size is calculated. The obtained area average grain size is defined as the average grain size of the surface layer.

Since the residual austenite is not a structure formed by phase transformation at 600° C. or lower and has no effect of dislocation accumulation, the residual austenite is not included as a target in the analysis in the present measurement method. As described above, the EBSP-OIM method, the residual austenite having a crystal structure of fcc can be excluded from the analysis target.

3. Tensile Strength Properties

Among the mechanical properties of the hot-rolled steel sheet, the tensile strength properties (tensile strength and total elongation) were evaluated in accordance with JIS Z 2241: 2011. A test piece is a No. 5 test piece of JIS Z 2241: 2011. A sampling position of the tensile test piece may be ¼ portion from the end portion in the sheet width direction, and the direction perpendicular to the rolling direction may be the longitudinal direction.

The hot-rolled steel sheet according to the present embodiment has a tensile (maximum) strength of 980 MPa or more. When the tensile strength is less than 980 MPa, an applicable component is limited, and the contribution of weight reduction of the vehicle body is small. An upper limit is not particularly limited, and may be 1780 MPa from the viewpoint of suppressing wearing of die. Further, the product (TS×El) of the tensile strength and the total elongation which are indices of ductility is preferably 15000 MPa % or more. When the product of the tensile strength and the total elongation is less than 15000 MPa %, an applicable component is limited, and the contribution of weight reduction of the vehicle body is small.

4. Sheet Thickness

The sheet thickness of the hot-rolled steel sheet according to the present embodiment is not particularly limited and may be 0.6 to 8.0 mm. When the sheet thickness of the hot-rolled steel sheet is less than 0.6 mm, it becomes difficult to secure the rolling completion temperature and the rolling force becomes excessive, which may make hot rolling difficult. Therefore, the sheet thickness of the hot-rolled steel sheet according to the present embodiment may be 0.6 mm or more. The sheet thickness is preferably 1.2 mm or more or 1.4 mm or more. On the other hand, the sheet thickness is more than 8.0 mm, it becomes difficult to refine the microstructure, and it may become difficult to obtain the microstructure described above. Therefore, the sheet thickness may be 8.0 mm or less. The sheet thickness is preferably 6.0 mm or less.

5. Others (5-1) Plating Layer

The hot-rolled steel sheet according to the present embodiment having the above-described chemical composition and microstructure may be a surface-treated steel sheet provided with a plating layer on the surface for the purpose of improving corrosion resistance and the like. The plating layer may be an electro plating layer or a hot-dip plating layer. Examples of the electro plating layer include electrogalvanizing and electro Zn—Ni alloy plating. Examples of the hot-dip plating layer include hot-dip galvanizing, hot-dip galvannealing, hot-dip aluminum plating, hot-dip Zn—Al alloy plating, hot-dip Zn—Al—Mg alloy plating, and hot-dip Zn—Al—Mg—Si alloy plating. The plating adhesion amount is not particularly limited and may be the same as before. Further, it is also possible to further enhance the corrosion resistance by applying an appropriate chemical conversion treatment (for example, application and drying of a silicate-based chromium-free chemical conversion treatment liquid) after plating.

6. Manufacturing Conditions

A suitable method for manufacturing the hot-rolled steel sheet according to the present embodiment having the above-mentioned chemical composition and microstructure is as follows.

In order to obtain the hot-rolled steel sheet according to the present embodiment, it is important that after performing heating the slab under predetermined conditions, hot rolling is performed and accelerated cooling is performed to a predetermined temperature range, thereafter, slow cooling is performed, and the cooling history is controlled until coiling.

In the suitable method for manufacturing the hot-rolled steel sheet according to the present embodiment, the following steps (1) to (7) are sequentially performed. The temperature of the slab and the temperature of the steel sheet in the present embodiment refer to the surface temperature of the slab and the surface temperature of the steel sheet.

(1) The slab is retained in a temperature range of 700° C. to 850° C. for 900 seconds or longer, then further heated, and retained in a temperature range of 1100° C. or higher for 6000 seconds or longer.

(2) Hot rolling is performed in a temperature range of 850° C. to 1100° C. so that the total sheet thickness is reduced by 90% or more.

(3) The Hot rolling is completed so that a finishing temperature Tf becomes equal to or higher than a temperature T1 (° C.) represented by Formula (1).

(4) Within one second after the completion of the hot rolling, cooling is performed to a temperature range of finishing temperature Tf−50° C. or lower. Then, accelerated cooling is performed to a temperature range of 600° C. to 730° C. at an average cooling rate of 50° C./sec or higher. Here, cooling to a temperature range of finishing temperature Tf−50° C. or lower within one second after the completion of the hot rolling is a more preferable cooling condition.

(5) In the temperature range of 600° C. to 730° C., slow cooling at an average cooling rate of less than 5° C./s is performed for 2.0 seconds or longer.

(6) Cooling is performed to a temperature range of 250° C. or lower at an average cooling rate of 50° C./s or higher.

(7) Coiling is performed in a temperature range of 250° C. or lower.

$$T1(^\circ C.)=868-396\times[C]-68.1\times[Mn]+24.6\times[Si]-36.1\times[Ni]-24.8\times[Cr]-20.7\times[Cu]+250\times[sol.\ Al] \quad (1)$$

However, the [element symbol] in Formula (1) indicates the content (mass %) of each element in the steel. When an element is not contained, substitution is performed with 0.

(6-1) Slab, Slab Temperature when Subjected to Hot Rolling, and Retention Time

As a slab to be subjected to hot rolling, a slab obtained by continuous casting, a slab obtained by casting and blooming, and the like can be used, and slabs obtained by performing hot working or cold working on these slabs as necessary can be used. The slab to be subjected to hot rolling is required to be retained in a temperature range of 700° C. to 850° C. during heating for 900 seconds or longer, then further be heated and retained in a temperature range of 1100° C. or higher for 6000 seconds or longer. During retaining in the temperature range of 700° C. to 850° C., the steel sheet temperature may be fluctuated or be constant in the temperature range. Furthermore, during retaining at 1100° C. or higher, the steel sheet temperature may be fluctuated or be constant in the temperature range of 1100° C. or higher.

In the austenite transformation at 700° C. to 850° C., when Mn is distributed between the ferrite and the austenite and the transformation time becomes longer, Mn can be diffused in the ferrite region. Accordingly, the Mn microscopic segregation unevenly distributed in the slab can be eliminated, and the standard deviation of the Mn concentration can be significantly reduced. Further, in order to make the austenite grains uniform during heating of the slab heating, the slab should be heated at 1100° C. or higher for 6000 seconds or longer.

In hot rolling, it is preferable to use a reverse mill or a tandem mill for multi-pass rolling. Particularly, from the viewpoint of industrial productivity, it is more preferable that at least the final several stages are hot-rolled using a tandem mill.

(6-2) Rolling Reduction of Hot Rolling: Total Sheet Thickness Reduction of 90% or More in Temperature Range of 850° C. to 1100° C.

Performing the hot rolling to obtain a total sheet thickness reduction of 90% or more in the temperature range of 850° C. to 1100° C. makes it possible that the accumulation of strain energy inside unrecrystallized austenite grains is promoted while achieving refinement mainly of the recrystallized austenite grains, and the atomic diffusion of Mn is promoted while promoting the recrystallization of the austenite to reduce the standard deviation of the Mn concentration. Therefore, the hot rolling is performed in a temperature range of 850° C. to 1100° C. so that the total sheet thickness is reduced by 90% or more.

The sheet thickness reduction in a temperature range of 850° C. to 1100° C. can be expressed as $(t_0-t_1)/t_0\times100(\%)$ when an inlet sheet thickness before the first pass in the rolling in this temperature range is to and an outlet sheet thickness after the final pass in the rolling in this temperature range is $t_1$.

(6-3) Finishing Temperature Tf: T1 (° C.) or Higher

The finishing temperature Tf is desirably set to T1 (° C.) or higher. By setting the finishing temperature Tf to T1 (° C.) or higher, an excessive increase in the number of ferrite nucleation sites in the austenite can be suppressed, and the formation of the ferrite in the final structure (the microstructure of the hot-rolled steel sheet after manufacturing) can be suppressed, and it is possible to obtain the hot-rolled steel sheet having high strength.

(6-4) Within one second after the completion of the hot rolling, cooling is performed to a temperature range of finishing temperature Tf−50° C. or lower. Then, accelerated cooling is performed to a temperature range of 600° C. to 730° C. at an average cooling rate of 50° C./sec or higher. Here, cooling to a temperature range of finishing temperature Tf−50° C. or lower within one second after the completion of the hot rolling is a more preferable cooling condition.

In order to suppress the growth of austenite crystal grains refined by hot rolling, it is more preferable to perform cooling within one second after the completion of the hot rolling by 50° C. or higher. In order to perform cooling to a temperature range of finishing temperature Tf−50° C. or lower within one second after the completion of the hot rolling, cooling at a large average cooling rate is performed immediately after the completion of the hot rolling, for example, cooling water may be sprayed on the surface of the steel sheet. When cooling is performed to a temperature range of Tf-50° C. or lower within one second after the completion of the hot rolling, the grain size of the surface layer can be refined and resistance to cracking inside a bend can be improved.

Also, when performing accelerated cooling to 730° C. or lower at the average cooling rate of 50° C./sec or higher, the formation of ferrite and pearlite which have a small amount of precipitation hardening can be suppressed. Accordingly, the strength of the hot-rolled steel sheet is enhanced. The average cooling rate referred here refers to a value obtained by dividing the temperature drop width of the steel sheet from the start of the accelerated cooling to the completion of the accelerated cooling by the time required from the start of the accelerated cooling to the completion of the accelerated cooling.

In the cooling after the completion of the hot rolling, when the cooling time to the temperature range of the finishing temperature Tf−50° C. or lower is longer than one second, the resistance to cracking inside a bend is deteriorated. Further, when the average cooling rate during the accelerated cooling is lower than 50° C./sec or the cooling stop temperature is higher than 730° C., ferritic transformation and/or pearlitic transformation in which the amount of precipitation hardening inside the steel sheet is small becomes remarkable, and it becomes difficult to obtain a tensile strength of 980 MPa or more. Therefore, it is preferable that within one second after the completion of the hot rolling, cooling is performed to a temperature range of finishing temperature Tf-50° C. or lower, and then, accelerated cooling is performed to 730° C. or lower at an average cooling rate of 50° C./sec or higher. The upper limit of the cooling rate is not particularly specified, but when the cooling rate is increased, the cooling equipment becomes large and the equipment cost increases. Therefore, considering the equipment cost, the average cooling rate is preferably 300° C./sec or lower. Further, the cooling stop temperature of accelerated cooling may be set to 600° C. or higher.

(6-5) In a temperature range of 600° C. to 730° C., slow cooling at an average cooling rate of lower than 5° C./s is performed for 2.0 seconds or longer.

The precipitation hardened ferrite can be sufficiently precipitated by performing slow cooling at an average cooling rate of lower than 5° C./s for 2.0 seconds or longer in a temperature range of 600° C. to 730° C. As a result, both the strength and the ductility of the hot-rolled steel sheet can be obtained. The average cooling rate referred here refers to a value obtained by dividing the temperature drop width of the steel sheet from the cooling stop temperature of the accelerated cooling to an end temperature of the slow cooling by the time required from the stop of accelerated cooling to the end of the slow cooling.

When the time for slow cooling is shorter than 2.0 seconds, the area ratio of the precipitation hardened ferrite does not reach a desired amount, and it becomes difficult to obtain the action. Accordingly, in the temperature range of 600° C. to 730° C., slow cooling at an average cooling rate of lower than 5° C./s is performed for 2.0 seconds or longer. The time for the slow cooling is preferably 3.0 seconds or longer and more preferably 4.0 seconds or longer. The upper limit of the time for the slow cooling is determined by the equipment layout, and may be generally shorter than 10.0 seconds. In addition, although the lower limit of the average cooling rate for slow cooling is not particularly set, raising the temperature without cooling may require a large investment in equipment. Therefore, the lower limit may be set to 0° C./s or higher.

(6-6) Average Cooling Rate to Coiling Temperature: 50° C./Sec or Higher

In order to suppress the area fraction of the pearlite to obtain the tensile strength of 980 MPa or more, the average cooling rate from the cooling stop temperature of the slow cooling to the coiling temperature is set to 50° C./sec or higher. Accordingly, the primary phase structure can be full hard. The average cooling rate referred here refers to a value obtained by dividing the temperature drop width of the steel sheet from the cooling stop temperature of the slow cooling at the average cooling rate of lower than 5° C./sec to the coiling temperature by the time required from the stop of slow cooling at the average cooling rate of lower than 5° C./sec to coiling.

When the average cooling rate is lower than 50° C./sec, the area fraction of the pearlite increases, the strength of the hot-rolled steel sheet decreases, and the ductility decreases. Therefore, the average cooling rate from the cooling stop temperature of the slow cooling at the average cooling rate of lower than 5° C./sec to the coiling temperature is set to 50° C./sec or higher.

(6-7) Coiling Temperature: 250° C. or Lower

The coiling temperature is set to 250° C. or lower. When setting the coiling temperature to be higher than 250° C., the transformation driving force from austenite to bcc decreases and the flow stress of austenite decreases. Therefore, during the bainite and martensitic transformation from austenite, the length $L_{60}$ of the grain boundary having a crystal misorientation crystal misorientation of 60° about the <110> direction increases, and $L_{60}/L_7$ becomes more than 0.60. As a result, excellent shearing workability cannot be obtained. Therefore, the coiling temperature is set to 250° C. or lower.

EXAMPLES

Next, the effects of one aspect of the present invention will be described more specifically by way of examples, but the conditions in the examples are condition examples adopted for confirming the feasibility and effects of the present invention. The present invention is not limited to these condition examples. The present invention can employ various conditions as long as the object of the present invention is achieved without departing from the gist of the present invention.

Steels having chemical compositions shown in Steel Nos. A to V in Tables 1 and 2 were melted and continuously cast to manufacture slabs having a thickness of 240 to 300 mm. The obtained slabs were used to obtain hot-rolled steel sheets shown in Table 4 under the manufacturing conditions shown in Table 3. The average cooling rate of the slow cooling was set to less than 5° C./s.

For the obtained hot-rolled steel sheet, the area fraction of the microstructure, $L_{60}/L_7$, the standard deviation of the Mn concentration, and the average grain size of the surface layer was determined by the above-described method. The obtained measurement results are shown in Table 4.

Evaluation Method of Properties of Hot-Rolled Steel Sheet (1) Tensile Strength Properties Among the mechanical properties of the obtained hot-rolled steel sheet, the tensile strength properties (tensile strength TS and total elongation EL) were evaluated according to JIS Z 2241: 2011. A test piece was a No. 5 test piece of JIS Z 2241: 2011. The sampling position of the tensile test piece may be ¼ portion from the end portion in the sheet width direction, and the direction perpendicular to the rolling direction was the longitudinal direction.

In a case where the tensile strength TS≥980 MPa and the tensile strength TS x total elongation El≥15000 (MPa-%) were satisfied, the hot-rolled steel sheet was determined to be as acceptable as a hot-rolled steel sheet having excellent strength and ductility.

(2) Shearing Workability

The shearing workability of the hot-rolled steel sheet was measured by a punching test. A punched hole was prepared with a hole diameter of 10 mm, a clearance of 25%, and a punching speed of 3 m/s. Next, a cross section of the punched hole perpendicular to the rolling direction was embedded in a resin, and the cross-sectional shape was imaged with a scanning electron microscope. In the obtained observation photograph, the processed cross section as shown in FIG. 1 can be observed. In observation photograph, a straight line 1 along the lower surface of the steel sheet and a straight line 2 passing through the apex (the farthest point in the sheet thickness direction from the lower surface of the steel plate in a burr portion) of the burr and parallel to the lower surface of the steel sheet were drawn, and the distance between the two straight lines (d in FIG. 1) was defined as the burr height. When the maximum burr height is measured for 10 punched holes at each clearance and the maximum burr height is 15.0 μm or less even with a clearance of 25%, it is determined to be as acceptable as a hot-rolled steel sheet having excellent shearing workability.

(3) Resistance to Cracking Inside Bend

As a bending test piece, a strip-shaped test piece having a size of 100 mm×30 mm was cut out from a ½ position in the width direction of the hot-rolled steel sheet, and the resistance to cracking inside a bend was evaluated by the following bending test.

Regarding both bending (L-axis bending) in which a bending ridge is parallel to the rolling direction (L direction) and bending (C-axis bending) in which a bending ridge is parallel to the direction perpendicular to the rolling direction (C direction), the resistance to cracking inside a bend is studied in accordance with JIS Z 2248: 2014 (V block 90° bending test), the minimum bending radius at which cracks are not initiated is determined, and a value obtained by dividing an average value of the minimum bending radii of the L axis and the C axis by the sheet thickness is defined as a limit bending R/t, which is an index value of bendability. When the R/t≤2.5, it was determined that the hot-rolled steel sheet was excellent in resistance to cracking inside a bend.

However, regarding the presence or absence of cracks, a crack was observed with an optical microscope, after mirror polishing the cross section obtained by cutting the test piece after the V block 90° bending test on a plane parallel to the bending direction and perpendicular to the sheet surface, and when the crack length observed inside the bend of the test piece is more than 30 μm, it is determined that there is a crack.

The obtained measurement results are shown in Table 4.

TABLE 1

| Steel | Mass % Remainder consisting of Fe and impurities | | | | | | | | | | | | |
|---|---|---|---|---|---|---|---|---|---|---|---|---|---|
| No. | C | Si | Mn | Ti | Nb | V | Ti + Nb + V | sol. Al | P | S | N | O | Remarks |
| A | 0.051 | 1.05 | 1.74 | 0.091 | | | 0.091 | 0.037 | 0.020 | 0.0012 | 0.0037 | 0.0019 | Invention Example |
| B | 0.099 | 1.09 | 1.79 | 0.101 | | | 0.101 | 0.031 | 0.013 | 0.0045 | 0.0025 | 0.0030 | Invention Example |
| C | 0.160 | 1.18 | 1.75 | 0.119 | | | 0.119 | 0.052 | 0.010 | 0.0029 | 0.0039 | 0.0034 | Invention Example |
| D | 0.097 | 0.32 | 1.73 | 0.085 | | | 0.085 | 0.034 | 0.021 | 0.0032 | 0.0021 | 0.0028 | Invention Example |
| E | 0.075 | 2.76 | 1.90 | 0.099 | | | 0.099 | 0.030 | 0.024 | 0.0015 | 0.0009 | 0.0012 | Invention Example |
| F | 0.092 | 0.85 | 1.38 | 0.111 | | | 0.111 | 0.042 | 0.015 | 0.0040 | 0.0010 | 0.0033 | Invention Example |
| G | 0.084 | 1.14 | 3.72 | 0.107 | | | 0.107 | 0.036 | 0.025 | 0.0028 | 0.0018 | 0.0051 | Invention Example |
| H | 0.094 | 0.86 | 1.72 | 0.035 | 0.038 | | 0.073 | 0.045 | 0.018 | 0.0018 | 0.0045 | 0.0021 | Invention Example |
| I | 0.097 | 1.12 | 1.88 | | | 0.153 | 0.153 | 0.044 | 0.008 | 0.0049 | 0.0050 | 0.0037 | Invention Example |
| J | 0.096 | 1.03 | 1.87 | 0.028 | 0.021 | 0.057 | 0.106 | 0.041 | 0.013 | 0.0050 | 0.0041 | 0.0050 | Invention Example |
| K | 0.089 | 0.93 | 1.88 | 0.119 | | | 0.119 | 0.045 | 0.014 | 0.0035 | 0.0018 | 0.0047 | Invention Example |
| L | 0.080 | 0.89 | 1.62 | 0.113 | | | 0.113 | 0.056 | 0.011 | 0.0025 | 0.0052 | 0.0021 | Invention Example |
| M | 0.095 | 1.15 | 1.60 | 0.110 | | | 0.110 | 0.047 | 0.016 | 0.0032 | 0.0021 | 0.0042 | Invention Example |
| N | 0.077 | 1.14 | 1.67 | 0.108 | | | 0.108 | 0.049 | 0.017 | 0.0033 | 0.0050 | 0.0045 | Invention Example |
| O | 0.091 | 1.13 | 1.90 | 0.120 | | | 0.120 | 0.037 | 0.015 | 0.0027 | 0.0018 | 0.0051 | Invention Example |
| P | 0.044 | 0.92 | 1.85 | 0.119 | | | 0.119 | 0.032 | 0.013 | 0.0031 | 0.0047 | 0.0014 | Comparative Example |
| Q | 0.260 | 0.95 | 1.68 | 0.105 | | | 0.105 | 0.046 | 0.019 | 0.0031 | 0.0033 | 0.0054 | Comparative Example |
| R | 0.088 | 3.20 | 1.84 | 0.104 | | | 0.104 | 0.039 | 0.023 | 0.0030 | 0.0040 | 0.0018 | Comparative Example |
| S | 0.089 | 0.90 | 0.85 | 0.114 | | | 0.114 | 0.050 | 0.013 | 0.0014 | 0.0009 | 0.0024 | Comparative Example |
| T | 0.100 | 1.12 | 1.77 | 0.043 | 0.011 | | 0.054 | 0.051 | 0.018 | 0.0042 | 0.0026 | 0.0051 | Comparative Example |
| U | 0.101 | 1.83 | 1.82 | 0.130 | | | 0.130 | 0.035 | 0.016 | 0.0007 | 0.0050 | 0.0046 | Invention Example |
| V | 0.071 | 1.55 | 2.60 | 0.086 | | | 0.086 | 0.045 | 0.011 | 0.0028 | 0.0032 | 0.0024 | Invention Example |

An underline indicates that the value is outside a range of the present invention.

TABLE 2

| Steel | Mass % Remainder consisting of Fe and impurities | | | | | | | | | | | | | | | |
|---|---|---|---|---|---|---|---|---|---|---|---|---|---|---|---|---|
| No. | Cu | Cr | Mo | Ni | B | Ca | Mg | REM | Bi | Zr | Co | Zn | W | Sn | T1 | Remarks |
| A | | | | | | 0.0023 | 0.0018 | | | | | | | | 764 | Invention Example |
| B | | | | | | | | | | | | | | | 741 | Invention Example |
| C | | | | | | | | 0.0013 | | | | | | | 727 | Invention Example |
| D | | 0.39 | 0.27 | 0.12 | | | | | | | | | | | 714 | Invention Example |
| E | | | | | | | | | 0.005 | | | | 0.10 | | 784 | Invention Example |
| F | | | | | | | | | | | | | | | 769 | Invention Example |
| G | | | | | | | | | | | | | | | 618 | Invention Example |
| H | | | | | | | | | | 0.01 | | | | | 746 | Invention Example |
| I | | | | | | | | | | | | | | | 740 | Invention Example |
| J | | | | | | | | | | | | | | | 738 | Invention Example |
| K | 0.13 | | | | | | | | | | 0.15 | | | | 736 | Invention Example |
| L | | 0.29 | | | | | | | | | | | | | 755 | Invention Example |
| M | | | 0.12 | | | | | | | | | | | 0.01 | 761 | Invention Example |
| N | | | | 0.28 | | | | | | | | | | | 754 | Invention Example |
| O | | | | | 0.0024 | | | | | | | 0.02 | | | 740 | Invention Example |
| P | | | | | | | | | | | | | | | 755 | Comparative Example |
| Q | | | | | | | | | | | | | | | 686 | Comparative Example |
| R | | | | | | | | | | | | | | | 796 | Comparative Example |
| S | | | | | | | | | | | | | | | 810 | Comparative Example |
| T | | | | | | | | | | | | | | | 748 | Comparative Example |
| U | | | | | | | | | | | | | | | 758 | Invention Example |
| V | | | | | | | | | | | | | | | 712 | Invention Example |

TABLE 3

| Production No. | Steel No. | Retention time in temperature range of 700° C. to 850° C. s | Heating temperature ° C. | Retention time in temperature, range of 1100° C. or higher s | Sheet thickness reduction at 850° C. to 1100° C. % | T1 | Finishing temperature Tf ° C. | Cooling amount within 1 second after hot rolling completion ° C. |
|---|---|---|---|---|---|---|---|---|
| 1 | A | 1346 | 1225 | 9016 | 93 | 764 | 954 | 100 |
| 2 | B | 1203 | 1230 | 9005 | 90 | 741 | 940 | 97 |
| 3 | B | 819 | 1218 | 7662 | 91 | 741 | 954 | 66 |
| 4 | B | 1194 | 1226 | 7673 | 87 | 741 | 969 | 114 |
| 5 | B | 1404 | 1217 | 5660 | 92 | 741 | 942 | 88 |
| 6 | B | 1350 | 1222 | 5386 | 92 | 741 | 938 | 80 |
| 7 | B | 1271 | 1213 | 9098 | 93 | 741 | 948 | 5 |
| 8 | B | 887 | 1222 | 7476 | 92 | 741 | 950 | 111 |
| 9 | B | 1285 | 1226 | 9002 | 91 | 741 | 965 | 104 |
| 10 | B | 1141 | 1229 | 7220 | 93 | 741 | 935 | 93 |
| 11 | B | 1278 | 1232 | 8292 | 91 | 741 | 964 | 100 |
| 12 | C | 1282 | 1223 | 7065 | 90 | 727 | 949 | 13 |
| 13 | D | 1545 | 1207 | 8018 | 91 | 714 | 960 | 77 |
| 14 | E | 1160 | 1230 | 8723 | 90 | 784 | 937 | 99 |
| 15 | F | 1315 | 1216 | 8814 | 90 | 769 | 937 | 111 |
| 16 | G | 1421 | 1221 | 8497 | 92 | 618 | 1019 | 120 |
| 17 | H | 1137 | 1191 | 7204 | 93 | 746 | 963 | 63 |
| 18 | I | 1349 | 1229 | 7788 | 91 | 740 | 964 | 82 |
| 19 | J | 1198 | 1229 | 8506 | 93 | 738 | 942 | 117 |
| 20 | K | 1212 | 1208 | 8922 | 93 | 736 | 952 | 118 |
| 21 | L | 1289 | 1194 | 6935 | 92 | 755 | 955 | 34 |
| 22 | M | 1292 | 1190 | 7295 | 93 | 761 | 940 | 100 |
| 23 | N | 1224 | 1214 | 8934 | 93 | 754 | 935 | 74 |
| 24 | O | 1297 | 1218 | 8243 | 92 | 740 | 936 | 108 |
| 25 | P | 1415 | 1215 | 7620 | 92 | 755 | 935 | 66 |
| 26 | Q | 1338 | 1192 | 7631 | 93 | 686 | 958 | 116 |
| 27 | R | 1515 | 1201 | 7686 | 90 | 796 | 960 | 93 |
| 28 | S | 1156 | 1217 | 7045 | 91 | 810 | 949 | 62 |
| 29 | T | 1436 | 1228 | 7950 | 91 | 748 | 942 | 65 |
| 30 | U | 1416 | 1228 | 7616 | 92 | 755 | 970 | 120 |
| 31 | V | 1127 | 1208 | 6938 | 91 | 686 | 943 | 69 |

| Production No. | Average cooling rate of accelerated cooling ° C./s | Cooling stop temperature of accelerated cooling ° C. | Slow cooling time in temperature range of 600° C. to 730° C. s | Average cooling rate from slow cooling step temperature to coiling temperature ° C./s | Coiling temperature ° C. | Remarks |
|---|---|---|---|---|---|---|
| 1 | 76 | 652 | 4.3 | 57 | 24 | Invention Example |
| 2 | 63 | 657 | 5.0 | 73 | 21 | Invention Example |
| 3 | 66 | 654 | 4.6 | 70 | 41 | Comparative Example |
| 4 | 63 | 680 | 6.1 | 65 | 20 | Comparative Example |
| 5 | 76 | 654 | 4.2 | 77 | 36 | Compatative Example |
| 6 | 66 | 650 | 4.6 | 55 | 285 | Comparative Example |
| 7 | 78 | 668 | 5.1 | 70 | 12 | Invention Example |
| 8 | 64 | 662 | 1.2 | 79 | 41 | Comparative Example |
| 9 | 22 | 673 | 5.9 | 76 | 28 | Comparative Example |
| 10 | 66 | 749 | 5.0 | 59 | 42 | Comparative Example |
| 11 | 63 | 665 | 5.5 | 30 | 21 | Comparative Example |
| 12 | 59 | 650 | 6.6 | 69 | 30 | Invention Example |
| 13 | 75 | 620 | 6.2 | 60 | 10 | Invention Example |
| 14 | 64 | 715 | 4.6 | 64 | 13 | Invention Example |
| 15 | 68 | 657 | 4.8 | 55 | 19 | Invention Example |
| 16 | 68 | 669 | 4,8 | 56 | 37 | Invention Example |
| 17 | 68 | 672 | 4.5 | 62 | 34 | Invention Example |
| 18 | 74 | 660 | 2.4 | 64 | 39 | Invention Example |
| 19 | 55 | 656 | 4.3 | 70 | 12 | Invention Example |
| 20 | 77 | 653 | 5.0 | 76 | 15 | Invention Example |
| 21 | 69 | 670 | 5.6 | 55 | 25 | Invention Ex amp le |
| 22 | 63 | 657 | 5.2 | 66 | 39 | Invention Example |
| 23 | 74 | 680 | 3.1 | 72 | 23 | Invention Example |
| 24 | 77 | 672 | 5.1 | 60 | 30 | Invention Example |
| 25 | 66 | 605 | 6.2 | 64 | 29 | Comparative Example |
| 26 | 64 | 728 | 5.1 | 65 | 12 | Comparative Example |
| 27 | 77 | 662 | 5.7 | 64 | 29 | Comparative Example |
| 28 | 76 | 658 | 6.2 | 69 | 40 | Comparative Example |

TABLE 3-continued

| | | | | | | |
|---|---|---|---|---|---|---|
| 29 | 68 | 658 | 6.3 | 65 | 38 | Comparative Example |
| 30 | 68 | 666 | 5.0 | 72 | 15 | Invention Example |
| 31 | 58 | 666 | 8.5 | 67 | 21 | Invention Example |

An underline indicates that the value is outside a range of the present invention and a manufacturing condition is not preferable.

TABLE 4

| Production No. | Steel No. | Sheet thickness mm | Ferrite Area % | Residual austenite Area % | Pearlite Area % | Remainder in microstructure Area % | $L_{60}/L_7$ — | Mn standard deviation Mass % |
|---|---|---|---|---|---|---|---|---|
| 1 | A | 2.3 | 57.3 | 0.0 | 0.0 | 42.7 | 0.40 | 0.45 |
| 2 | B | 2.3 | 24.1 | 0.0 | 0.0 | 75.9 | 0.32 | 0.42 |
| 3 | B | 2.3 | 25.9 | 0.0 | 0.0 | 74.1 | 0.37 | 0.62 |
| 4 | B | 2.3 | 21.6 | 0.0 | 0.0 | 78.4 | 0.41 | 0.63 |
| 5 | B | 2.3 | 27.6 | 0.0 | 0.0 | 72.4 | 0.29 | 0.62 |
| 6 | B | 2.3 | 25.5 | 0.0 | 0.0 | 74.5 | 0.71 | 0.63 |
| 7 | B | 2.3 | 28.0 | 0.0 | 0.0 | 72.0 | 0.43 | 0.44 |
| 8 | B | 2.3 | 12.8 | 0.0 | 0.0 | 87.2 | 0.38 | 0.62 |
| 9 | B | 2.3 | 21.9 | 0.0 | 8.3 | 69.8 | 0.42 | 0.44 |
| 10 | B | 2.3 | 50.8 | 0.0 | 2.9 | 16.3 | 0.35 | 0.43 |
| 11 | B | 2.3 | 22.8 | 0.0 | 12.5 | 64.7 | 0.40 | 0.47 |
| 12 | C | 2.3 | 15.2 | 2.1 | 4.2 | 78.5 | 0.43 | 0.42 |
| 13 | D | 2.3 | 16.2 | 0.0 | 0.0 | 83.8 | 0.30 | 0.46 |
| 14 | E | 2.3 | 46.5 | 2.7 | 0.0 | 50.8 | 0.43 | 0.49 |
| 15 | F | 2.3 | 55.9 | 0.0 | 0.0 | 44.1 | 0.43 | 0.34 |
| 16 | G | 1.6 | 18.3 | 0.0 | 0.0 | 81.7 | 0.36 | 0.58 |
| 17 | H | 2.3 | 20.2 | 0.0 | 0.0 | 79.8 | 0.31 | 0.38 |
| 18 | I | 2.3 | 15.8 | 0.0 | 0.0 | 84.2 | 0.36 | 0.40 |
| 19 | J | 2.3 | 24.5 | 0.0 | 0.0 | 75.5 | 0.35 | 0.49 |
| 20 | K | 6.0 | 26.2 | 0.0 | 0.0 | 73.8 | 0.39 | 0.41 |
| 21 | L | 2.3 | 19.7 | 0.0 | 0.0 | 80.3 | 0.42 | 0.39 |
| 22 | M | 2.6 | 25.2 | 0.0 | 0.0 | 74.8 | 0.35 | 0.47 |
| 23 | N | 2.6 | 16.6 | 0.0 | 0.0 | 83.4 | 0.34 | 0.43 |
| 24 | O | 2.6 | 21.7 | 0.0 | 0.0 | 78 3 | 0.29 | 0.49 |
| 25 | P | 2.6 | 38.6 | 0.0 | 0.0 | 61.4 | 0.58 | 0.48 |
| 26 | Q | 2.6 | 10.1 | 2.0 | 0.0 | 87.9 | 0.29 | 0.46 |
| 27 | R | 2.6 | 82.9 | 0.0 | 0.0 | 17.1 | 0.35 | 0.48 |
| 28 | S | 2.6 | 60.8 | 0,0 | 8.4 | 30.8 | 0.34 | 0.39 |
| 29 | T | 2.6 | 23.7 | 0.0 | 0.0 | 76.3 | 0.33 | 0.49 |
| 30 | U | 2.3 | 57.2 | 2.5 | 0.0 | 42.8 | 0.34 | 0.41 |
| 31 | V | 2.3 | 16.3 | 0.0 | 0.0 | 83.7 | 0.36 | 0.52 |

| Production No. | Average: grain size of surface layer μm | Tensile strength TS MPa | Total elongation EL % | TS × EL MPa · % | Maximum burr height μm | Limit bending R/t — | |
|---|---|---|---|---|---|---|---|
| 1 | 2.3 | 981 | 18.2 | 17854 | 9.9 | 2.5 | Invention Example |
| 2 | 2.4 | 1065 | 15.9 | 16934 | 12.5 | 2.2 | Invention Example |
| 3 | 2.4 | 1066 | 15.5 | 16523 | 16.8 | 2.5 | Comparative Example |
| 4 | 2.4 | 1044 | 15.8 | 16495 | 17.1 | 2.2 | Comparative Example |
| 5 | 2.6 | 1038 | 16.0 | 16608 | 15.2 | 2.5 | Comparative Example |
| 6 | 2.5 | 1014 | 15.8 | 16021 | 18.1 | 2.4 | Comparative Example |
| 7 | 3.4 | 1057 | 16.3 | 17190 | 12.1 | 2.7 | Invention Example |
| 8 | 2.7 | 1108 | 12.9 | 14293 | 15.4 | 2.4 | Comparative Example |
| 9 | 2.2 | 962 | 15.3 | 14719 | 10.2 | 2.3 | Comparative Example |
| 10 | 2.7 | 890 | 16.7 | 14863 | 13.7 | 2.4 | Comparative Example |
| 11 | 2.9 | 957 | 14.2 | 13589 | 10.4 | 2.8 | Comparative Example |
| 12 | 3.3 | 1332 | 15.4 | 20513 | 14.1 | 3.0 | Invention Example |
| 13 | 2.2 | 993 | 15.2 | 15094 | 10.3 | 2.5 | Invention Example |
| 14 | 2.3 | 1053 | 14.8 | 15584 | 12.8 | 2.5 | Inv ention Example |
| 15 | 2.4 | 993 | 16.3 | 16186 | 8.5 | 2.2 | Invention Example |
| 16 | 2.2 | 1092 | 15.5 | 16926 | 14.6 | 2.1 | Invention Example |
| 17 | 2.2 | 999 | 16.4 | 16384 | 11.3 | 2.2 | Invention Example |
| 18 | 2.2 | 1078 | 14.5 | 15631 | 13.7 | 2.4 | Invention Example |
| 19 | 2.6 | 1032 | 16.4 | 16925 | 13.6 | 2.3 | Invention Example |
| 20 | 2.9 | 1063 | 15.8 | 16795 | 13.1 | 2.3 | Invention Example |
| 21 | 3.5 | 1049 | 16.2 | 16994 | 13.9 | 2.6 | Invention Example |
| 22 | 2.5 | 1046 | 15.7 | 16422 | 11.3 | 2.3 | Invention Example |
| 23 | 2.8 | 1054 | 14.8 | 15599 | 13.9 | 2.0 | Invention Example |
| 24 | 2.8 | 1032 | 16.5 | 17028 | 11.4 | 2.4 | Invention Example |
| 25 | 2.2 | 886 | 18.9 | 16745 | 11.3 | 2.2 | Comparative Example |
| 26 | 2.7 | 1367 | 10.7 | 14627 | 10.7 | 2.6 | Comparative Example |
| 27 | 2.9 | 934 | 13.0 | 12142 | 13.7 | 2.8 | Comparative Example |

TABLE 4-continued

| | | | | | | | |
|---|---|---|---|---|---|---|---|
| 28 | 2.9 | 922 | 14.5 | 13369 | 13.8 | 2.6 | Comparative Example |
| 29 | 2.2 | 946 | 16.8 | 15893 | 10.7 | 2.4 | Comparative Example |
| 30 | 2.5 | 982 | 18.0 | 17676 | 11.0 | 2.3 | Invention Example |
| 31 | 2.0 | 1235 | 13.0 | 16055 | 14.5 | 2.1 | Invention Example |

An underline indicates that the value is outside a range of the present invention or represents a property which is not preferable.

As can be seen from Table 4, the production Nos. 1, 2, 7, 12 to 24, 30, and 31 according to Invention Example, hot-rolled steel sheets having excellent strength, ductility, and shearing workability were obtained. Furthermore, in Production Nos. 1, 2, 13 to 20, 22 to 24, 30, and 31 in which the average grain size of the surface layer is less than 3.0 μm, a hot-rolled steel sheet having excellent resistance to cracking inside a bend was obtained.

On the other hand, the production Nos. 3 to 6, 8 to 11, and 25 to 29 as Comparative Example were inferior in any one or more of the properties (tensile strength TS, total elongation EL, and shearing workability).

INDUSTRIAL APPLICABILITY

According to the above aspect of the present invention, it is possible to provide a hot-rolled steel sheet having excellent strength, ductility, and shearing workability. Further, according to a preferred embodiment according to the present invention, it is possible to obtain a hot-rolled steel sheet having the above-mentioned properties and further suppressing the initiation of cracking inside a bend, that is, having excellent resistance to cracking inside a bend.

The hot-rolled steel sheet according to the present invention is suitable as an industrial material used for vehicle members, mechanical structural members, and building members.

The invention claimed is:

1. A hot-rolled steel sheet comprising: as a chemical composition, by mass %:

C: 0.050% to 0.250%;
Si: 0.05% to 3.00%;
Mn: 1.00% to 4.00%;
one or two or more of Ti, Nb, or V: 0.060% to 0.500% in total;
sol. Al: 0.001% to 2.000%;
P: 0.100% or less;
S: 0.0300% or less;
N: 0.1000% or less;
O: 0.0100% or less;
Cu: 0% to 2.00%;
Cr: 0% to 2.00%;
Mo: 0% to 1.00%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or two or more of Zr, Co, Zn, or W: 0% to 1.00% in total;
Sn: 0% to 0.050%; and
a remainder consisting of Fe and impurities,
wherein a microstructure at a depth of ¼ of a sheet thickness from a surface and at a center position in a sheet width direction in a cross section parallel to a rolling direction
contains, by area %, less than 3.0% of residual austenite, 15.0% or more and less than 60.0% of ferrite, and less than 5.0% of pearlite, wherein a remainder in the microstructure is one or more of bainite and martensite,
has a ratio $L_{60}/L_7$ of a length $L_{60}$ of a grain boundary having a crystal misorientation of 60° to a length $L_7$ of a grain boundary having a crystal misorientation of 7° about a <110> direction of less than 0.60,
has a standard deviation of a Mn concentration of 0.60 mass % or less, and
has a tensile strength of 980 MPa or more.

2. The hot-rolled steel sheet according to claim 1,
wherein an average grain size of a surface layer is less than 3.0 μm.

3. The hot-rolled steel sheet according to claim 1,
wherein the hot-rolled steel sheet includes, as the chemical composition, by mass %, one or two or more selected from the group of:
Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

4. The hot-rolled steel sheet according to claim 2,
wherein the hot-rolled steel sheet includes, as the chemical composition, by mass %, one or two or more selected from the group of:
Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

5. A hot-rolled steel sheet comprising: as a chemical composition, by mass %:

C: 0.050% to 0.250%;
Si: 0.05% to 3.00%;
Mn: 1.00% to 4.00%;
one or two or more of Ti, Nb, or V: 0.060% to 0.500% in total;
sol. Al: 0.001% to 2.000%;
P: 0.100% or less;
S: 0.0300% or less;
N: 0.1000% or less;
O: 0.0100% or less;
Cu: 0% to 2.00%;
Cr: 0% to 2.00%;
Mo: 0% to 1.00%;
Ni: 0% to 2.00%;
B: 0% to 0.0100%;

Ca: 0% to 0.0200%;
Mg: 0% to 0.0200%;
REM: 0% to 0.1000%;
Bi: 0% to 0.020%;
one or two or more of Zr, Co, Zn, or W: 0% to 1.00% in total;
Sn: 0% to 0.050%; and
a remainder comprising Fe and impurities,
wherein a microstructure at a depth of ¼ of a sheet thickness from a surface and at a center position in a sheet width direction in a cross section parallel to a rolling direction
contains, by area %, less than 3.0% of residual austenite, 15.0% or more and less than 60.0% of ferrite, and less than 5.0% of pearlite, wherein a remainder in the microstructure is one or more of bainite and martensite,
has a ratio $L_{60}/L_7$ of a length $L_{60}$ of a grain boundary having a crystal misorientation of 60° to a length $L_7$ of a grain boundary having a crystal misorientation of 7° about a <110> direction of less than 0.60,
has a standard deviation of a Mn concentration of 0.60 mass % or less, and
has a tensile strength of 980 MPa or more.

* * * * *